US010886084B2

(12) United States Patent
Murata et al.

(10) Patent No.: US 10,886,084 B2
(45) Date of Patent: Jan. 5, 2021

(54) PRESSURE SWITCH AND HERMETICALLY SEALED ELECTRIC COMPRESSOR

(71) Applicant: UBUKATA INDUSTRIES CO., LTD., Nagoya (JP)

(72) Inventors: Hiroshi Murata, Nagoya (JP); Hideki Okumura, Nagoya (JP); Takehiko Okumura, Nagoya (JP); Kanichiro Sugiura, Nagoya (JP); Shinichi Takahashi, Tokyo (JP)

(73) Assignee: UBUKATA INDUSTRIES CO., LTD., Nagoya (JP)

( * ) Notice: Subject to any disclaimer, the term of this patent is extended or adjusted under 35 U.S.C. 154(b) by 0 days.

(21) Appl. No.: 16/534,760

(22) Filed: Aug. 7, 2019

(65) Prior Publication Data

US 2019/0362919 A1 Nov. 28, 2019

Related U.S. Application Data

(63) Continuation of application No. PCT/JP2017/005302, filed on Feb. 14, 2017.

(51) Int. Cl.
*H01H 35/34* (2006.01)
*F25B 49/02* (2006.01)

(52) U.S. Cl.
CPC ..... *H01H 35/34* (2013.01); *F25B 49/025* (2013.01); *F25B 2500/07* (2013.01); *F25B 2600/027* (2013.01); *F25B 2700/1931* (2013.01)

(58) Field of Classification Search
CPC .... H01H 35/34; H01H 35/2628; H01H 35/24; H01H 35/28; H01H 35/346; H01H 35/38;
(Continued)

(56) References Cited

U.S. PATENT DOCUMENTS 3,646,774 A * 3/1972 Werner ..... A23G 9/16 62/188
4,254,312 A * 3/1981 Migrin ..... B60C 23/0408 200/61.25
7,635,818 B2 * 12/2009 McCaffrey ..... H01H 35/2628 200/83 R

FOREIGN PATENT DOCUMENTS

JP S5313894 Y2 4/1987
JP H03029861 Y2 6/1991
(Continued)

OTHER PUBLICATIONS

International Search Report dated May 16, 2017, for International Patent Application No. PCT/JP2017/005302.

*Primary Examiner* — Edwin A. Leon
(74) *Attorney, Agent, or Firm* — Karceski IP Law, PLLC

(57) ABSTRACT

A pressure switch includes an airtight metallic pressure vessel. A contact mechanism is normally in a closed state and assumes an open state when a pressing force acts thereon. An airtight terminal, provided through an end surface section of the pressure vessel, is connected to the contact mechanism. A metallic first diaphragm is secured to a surface section at one end of the pressure vessel, is moved by a first moving pressure, and is reset by a reset pressure that is lower than the first moving pressure. A first plunger causes the contact mechanism to switch the open state. A metallic second diaphragm is secured to pressure vessel, is moved by a second moving pressure that is higher than the first moving pressure, and is not reset under at least an atmospheric pressure. A second plunger causes the contact mechanism to switch to the open state.

6 Claims, 7 Drawing Sheets

(58) Field of Classification Search
CPC ..... F25B 49/025; F25B 2500/07; F25B 2600/027; F25B 2700/1931
USPC ..... 200/16 B
See application file for complete search history.

(56) References Cited

FOREIGN PATENT DOCUMENTS

| | | | |
|---|---|---|---|
| JP | H0945191 | A | 2/1997 |
| JP | H11162307 | A | 6/1999 |
| JP | 2009036056 | A | 2/2009 |
| WO | 2009016779 | A1 | 2/2009 |

* cited by examiner

PRESSURE SWITCH AND HERMETICALLY SEALED ELECTRIC COMPRESSOR

CROSS-REFERENCE TO RELATED APPLICATIONS

This is a continuation of International Patent Application No. PCT/JP2017/005302, having an international filing date of Feb. 14, 2017, the entire content of which is incorporated herein by reference.

FIELD OF THE INVENTION

Embodiments of the present invention relate to a pressure switch and a hermetically sealed electric compressor.

BACKGROUND OF THE INVENTION

Conventional examples of a hermetically sealed electric compressor for use in a refrigeration cycle include one equipped with a pressure switch as a protection device. The pressure switch is housed together with a motor and others in a hermetically sealed vessel that constitutes a shell of the hermetically sealed electric compressor. When a pressure in the hermetically sealed vessel rises to cause a pressure abnormality, the pressure switch cuts off power supply to the motor to stop an operation of the compressor.

Here, when the pressure abnormality is caused by temporary overload of the refrigeration cycle, it is probable that any damage is not caused to devices in the hermetically sealed vessel or the hermetically sealed vessel itself. However, if repair or replacement of the pressure switch is required every time the pressure switch operates even in such a case, it takes a great deal of time and labor. Therefore, when the pressure abnormality is caused by the temporary overload of the refrigeration cycle, the pressure switch operates to cut off the power supply to the motor. Afterward, it is preferable to reset the pressure switch so that the hermetically sealed electric compressor can restart.

In contrast, when the pressure abnormality is caused in a range in excess of the temporary overload of the refrigeration cycle, there is a possibility that some devices in the hermetically sealed vessel or the hermetically sealed vessel itself is damaged. In this case, when the pressure switch is reset and the hermetically sealed electric compressor is restarted, further damage or the like can be caused to the internal devices or the like. Therefore, when the pressure abnormality is caused in the range in excess of the temporary overload of the refrigeration cycle, it is preferable, after the pressure switch operates to cut off the power supply to the motor, to inhibit the pressure switch from being reset so that the hermetically sealed electric compressor cannot restart.

However, a pressure switch having a conventional configuration is either a pressure switch that can be reset after an operation or a pressure switch that cannot be reset after the operation, and there has not been any pressure switches having both of the above described configurations. At the same time, in recent years, there has been high demand for miniaturization of a compressor and the like. However, the hermetically sealed vessel houses the devices, wires and others with high density. It is therefore difficult to leave a mounting space to provide both of the pressure switch that can be reset after the operation and the pressure switch that cannot be reset after the operation.

SUMMARY OF THE INVENTION

To solve the above described problems, there are provided a pressure switch that is operable in two modes of a mode in which the pressure switch can be reset and a mode in which the pressure switch cannot be reset in accordance with a pressure, and a hermetically sealed electric compressor in which the pressure switch is used.

A pressure switch of an embodiment includes an airtight metallic pressure vessel; a contact mechanism which is provided inside the pressure vessel, and which is normally in a closed state and assumes an open state when a pressing force acts thereon; at least one airtight terminal provided through an end surface section of the pressure vessel and connected to the contact mechanism; a metallic first diaphragm which is air-tightly secured to a surface section at one end of the pressure vessel, and which is moved by a first moving pressure and is to be reset by a reset pressure that is lower than the first moving pressure; a first plunger provided through the surface section at the one end of the pressure vessel, and caused by the movement of the first diaphragm to press the contact mechanism and then switch to the open state; a metallic second diaphragm which is air-tightly secured to a surface section at the other end of the pressure vessel, and which is moved by a second moving pressure that is higher than the first moving pressure and is not to be reset under at least an atmospheric pressure; and a second plunger provided through the surface section at the other end of the pressure vessel, and caused by the movement of the second diaphragm to press the contact mechanism and then switch to the open state.

Furthermore, a hermetically sealed electric compressor of one embodiment includes an airtight compressor vessel, a compression mechanism provided inside the compressor vessel to compress and discharge a refrigerant, a motor provided inside the compressor vessel to drive the compression mechanism, and the above pressure switch provided inside the compressor vessel and connected to a power line of the motor.

DESCRIPTION OF EMBODIMENT(S) OF THE INVENTION

Figure 1:
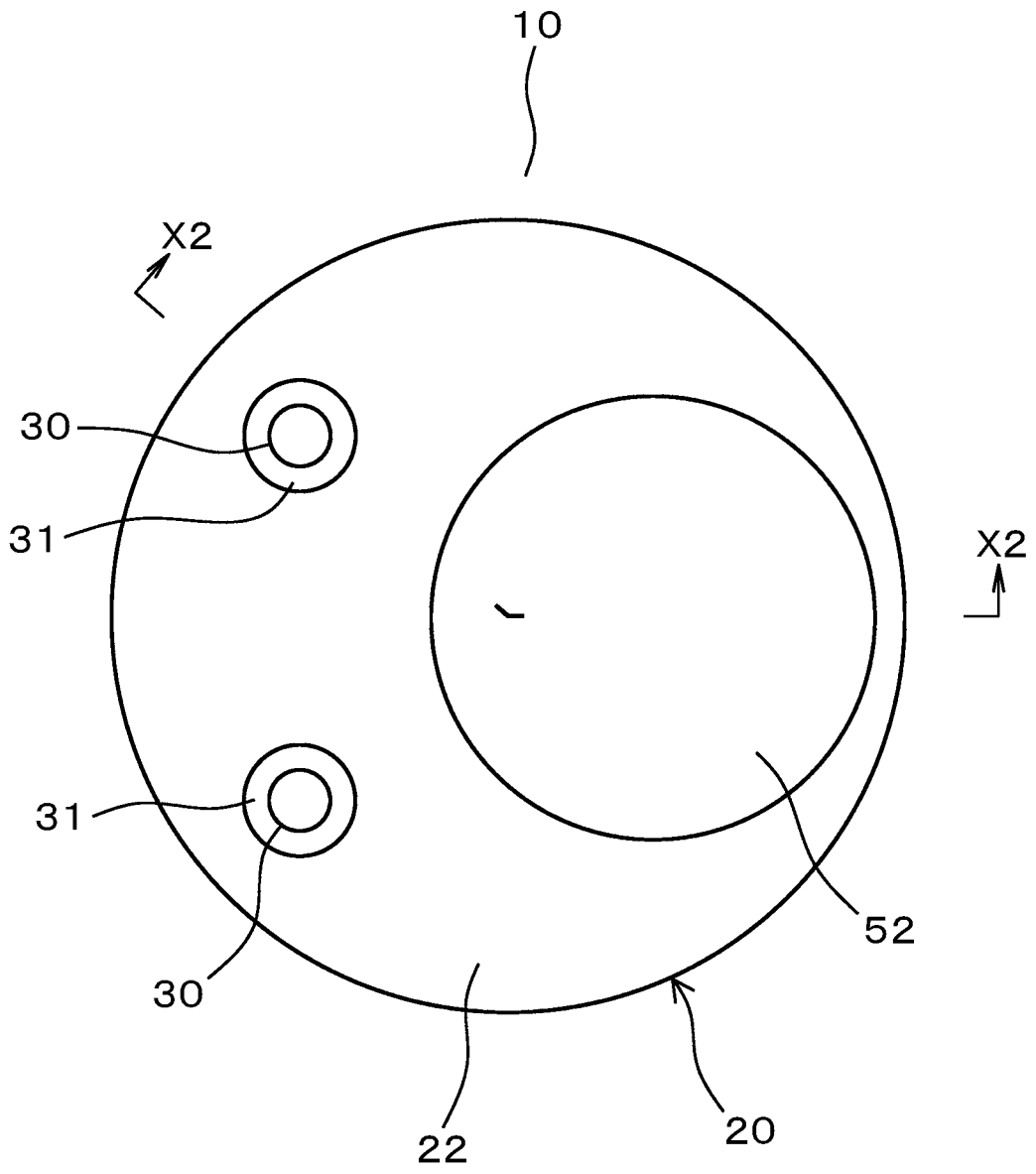
FIG. 1 is a plan view showing a pressure switch according to a first embodiment.

Hereinafter, a plurality of embodiments will be described with reference to the drawing. Note that substantially the same elements in the respective embodiments are denoted with the same reference signs, and descriptions thereof are omitted.

First Embodiment

Firstly, a first embodiment will be described with reference to FIG. 1 to FIG. 5.

Figure 2:
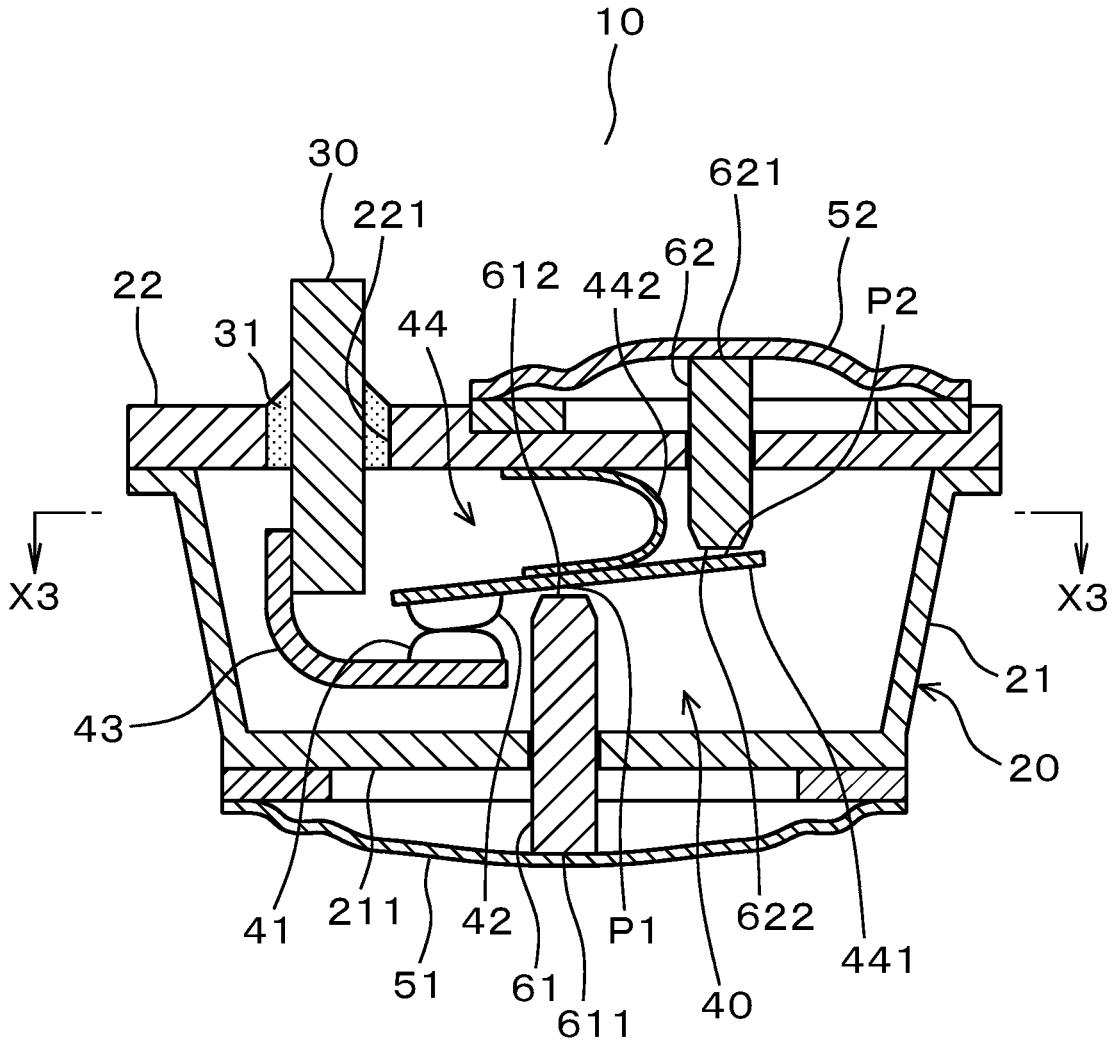
FIG. 2 is a cross-sectional view of the pressure switch according to the first embodiment which is taken along the line X2-X2 of FIG. 1.
Figure 3:
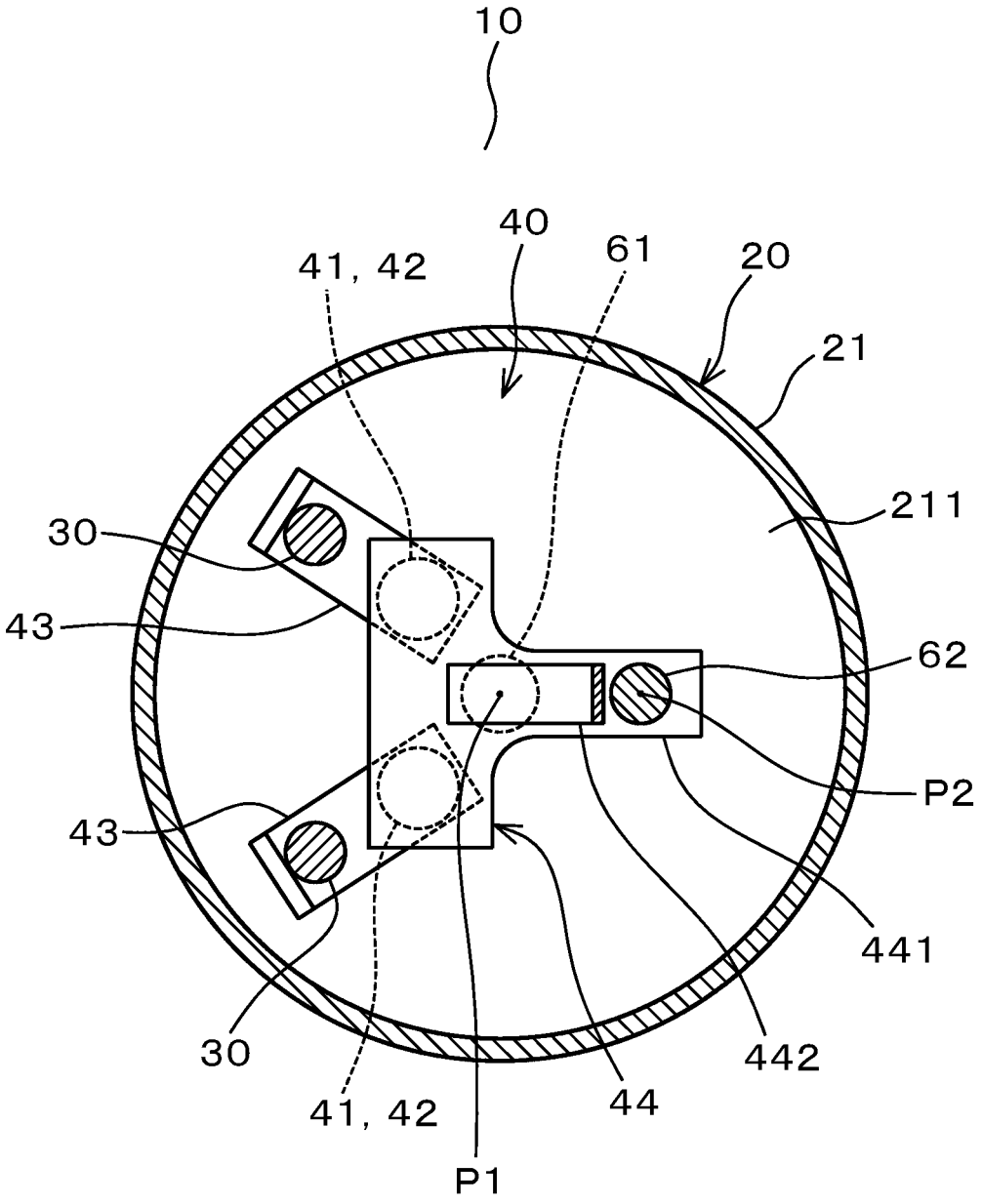
FIG. 3 is a cross-sectional view of the pressure switch according to the first embodiment which is taken along the line X3-X3 of FIG. 2.

A pressure switch 10 shown in FIG. 1 to FIG. 3 is a pressure-responsive switch including a set of contacts which are normally in a closed state, and brings the contact into an open state in response to two different types of pressure. As shown in FIG. 1 and FIG. 2, the pressure switch 10 includes a pressure vessel 20. The pressure vessel 20 is a metallic vessel having a pressure resistance, airtightness, and conductivity, and constitutes a shell of the pressure switch 10.

As shown in FIG. 2, the pressure vessel 20 has a vessel body 21 and a lid plate 22. The vessel body 21 is formed in a substantially cylindrical vessel shape having a bottom portion 211 at one end and having an opening at the other end, for example, by squeeze processing or the like. In the present embodiment, the vessel body 21 is formed in the substantially cylindrical vessel shape having an inner diameter that increases as the shape extends from the bottom portion 211 toward an open side. The lid plate 22 is a metallic plate which is a disc in this case, and is welded and fixed over an entire periphery of the vessel body 21 on the open side. Consequently, the lid plate 22 air-tightly closes an opening of the vessel body 21. In this case, the bottom portion 211 constitutes a surface section at one end of the pressure vessel 20, and a lid plate 22 side constitutes a surface section at the other end of the pressure vessel 20.

Note that the vessel body 21 may be configured such that the body does not have the bottom portion 211. That is, in this case, the vessel body can be formed in a tubular shape such that both surface sections at the one end and the other end are open. Furthermore, lid plates are welded and fixed to openings of the vessel body on both sides, and consequently, in the pressure vessel, both side openings of the vessel body are air-tightly closed with the lid plates.

The pressure switch 10 includes at least one airtight terminal 30. In the present embodiment, the pressure switch 10 includes two airtight terminals 30 as shown in FIG. 1 and FIG. 3. The airtight terminal 30 has conductivity and is provided through an end surface section of the pressure vessel 20. In the present embodiment, each airtight terminal 30 is present at a position shifted from a center of the lid plate 22, and is passed through a hole 221 formed in the lid plate 22. That is, in the present embodiment, the airtight terminal 30 is provided in the surface section at the other end of the pressure vessel 20. Around the airtight terminal 30, that is, inside the hole 221, an electrically insulating filler 31 such as glass is provided. Consequently, the airtight terminal 30 is fixed to the lid plate 22, that is, the pressure vessel 20 in an airtight and electrically insulated manner.

As shown in FIG. 2 and FIG. 3, the pressure switch 10 includes a contact mechanism 40. The contact mechanism 40 is provided inside the pressure vessel 20. The contact mechanism 40 has a fixed contact 41 and a movable contact 42. The contact mechanism 40 is a mechanism that brings the fixed contact 41 and the movable contact 42 away from and into contact with each other, that is, opens and closes the contacts. In the present embodiment, the pressure switch 10 has two fixed contacts 41 and two movable contacts 42 correspondingly to two airtight terminals 30.

The contact mechanism 40 has a fixed member 43 and a movable mechanism section 44. In the present embodiment, the number of the fixed members 43 corresponds to the number of the airtight terminals 30 and the number of the fixed contacts 41. That is, in the present embodiment, the pressure switch 10 has two fixed members 43 correspondingly to two airtight terminals 30 and two fixed contacts 41.

The fixed member 43 is formed by bending a conductive metallic plate material, and is provided to extend from an airtight terminal 30 side toward a center of the pressure vessel 20. As shown in FIG. 2 and FIG. 3, an end portion of the airtight terminal 30 inside the pressure vessel 20 is secured to one end of the fixed member 43 by welding or the like. Consequently, the airtight terminal 30 is electrically and physically connected to the fixed member 43. That is, the airtight terminal 30 is welded to the fixed member 43, and is accordingly electrically and physically connected to the contact mechanism 40.

The fixed contact 41 is formed in a semispherical shape by a conductive material, for example, a metal. The fixed contact 41 is secured to the other end of the fixed member 43 by the welding or the like. Consequently, the fixed contact 41 is electrically and physically connected to the fixed member 43. That is, the fixed contact 41 is electrically connected to the airtight terminal 30 via the fixed member 43.

The movable mechanism section 44 is a mechanism configured such that the movable contact 42 is movable away from and into contact with the fixed contact 41. In the present embodiment, the pressure switch 10 includes one movable mechanism section 44. The one movable mechanism section 44 simultaneously brings two movable contacts 42 away from and into contact with two fixed contacts 41.

The movable mechanism section 44 has a movable portion 441 and an elastic portion 442. As shown in FIG. 3, the movable portion 441 is formed in, for example, a T-shape by a conductive metallic plate material. The movable contact 42 is formed in a semispherical shape by a conductive material, for example, a metal in the same manner as in the fixed contact 41. Two movable contacts 42 are provided at positions that face the fixed contacts 41 on the movable portion 441. That is, the two movable contacts 42 are secured to a surface on a bottom portion 211 side at both ends of a bifurcated portion of the movable portion 441 by the welding or the like.

The elastic portion 442 is a conductive elastic member. The elastic portion 442 has one end fixed to the pressure vessel 20 in a vicinity of a central portion of the lid plate 22 in this case, and has the other end that comes in contact with a vicinity of a central portion of the movable portion 441. Consequently, the movable contact 42 is electrically connected to the lid plate 22 of the pressure vessel 20 via the movable portion 441 and the elastic portion 442. In this configuration, the elastic portion 442 urges the movable portion with an elastic force of the elastic portion 442 so that the fixed contact 41 and the movable contact 42 assume the closed state, and the elastic portion supports the movable portion 441 so that the movable contact 42 is movable in a direction away from the fixed contact 41.

In the present embodiment, the elastic portion 442 is a leaf spring formed by bending a conductive metallic plate into a U-shape. One end of the U-shape of the elastic portion 442 is secured to the lid plate 22 of the pressure vessel 20 by the welding or the like, and the other end thereof is secured to the central portion of the movable portion 441 by the welding or the like. Consequently, the elastic portion 442 electrically connects the movable contact 42 to the pressure vessel 20 via the movable portion 441 and the elastic portion 442, and swingably supports the movable portion 441.

Note that in the above configuration, the movable portion 441 and the elastic portion 442 are separately formed, and connected to each other by the welding or the like. However, this configuration is not restrictive. For example, the movable portion 441 and the elastic portion 442 may be integrally formed by punching formation or the like. Furthermore, the elastic portion 442 is not limited to the U-shaped leaf spring, and may be, for example, a coil spring. In this case, the elastic portion 442 including the coil spring supports the movable portion 441 so that the elastic portion can move in parallel between the bottom portion 211 and the lid plate 22 in addition to the swinging.

As shown in FIG. 2 and FIG. 3, the movable portion 441 has a first pressing point P1 and a second pressing point P2. The first pressing point P1 is set to one surface of both plate-like surfaces of the movable portion 441, and the second pressing point P2 is set to the other surface of both the plate-like surfaces of the movable portion 441. Then, a distance from the movable contact 42 to the first pressing point P1 is different from a distance from the movable contact 42 to the second pressing point P2. In this case, the distance from the second pressing point P2 to the movable contact 42 is longer than the distance from the first pressing point P1 to the movable contact.

Specifically, the first pressing point P1 is present in a vicinity of the central portion of the movable portion 441, and is set to the surface on the bottom portion 211 side in the movable portion 441. In this case, the first pressing point P1 is present in a vicinity of a portion in which the movable portion 441 is in contact with the elastic portion 442, that is, a fulcrum portion of the swinging of the movable portion 441, and is set to the surface opposite to the fulcrum portion in the movable portion 441. The second pressing point P2 is opposite to the movable contact 42 via the first pressing point P1, and is set to the surface on a fulcrum side in the movable portion 441.

In this configuration, the movable portion 441 is urged by the elastic force of the elastic portion 442 so that the fixed contact 41 and the movable contact 42 assume the closed state. Therefore, in the contact mechanism 40, the fixed contact 41 and the movable contact 42 come in contact and assume the closed state at a normal time when any pressing force does not act on the movable portion 441. In contrast, when the pressing force acts on the first pressing point P1 or the second pressing point P2 of the movable portion 441, the movable portion 441 swings so that the movable contact 42 is moved away from the fixed contact 41. Consequently, the contact mechanism 40 assumes the open state in which electric connection between the fixed contact 41 and the movable contact 42 is cut off, when the pressing force acts on the first pressing point P1 or the second pressing point P2 of the movable portion 441.

Furthermore, the pressure switch 10 includes a first diaphragm 51, a second diaphragm 52, a first plunger 61, and a second plunger 62. The first diaphragm 51 and the second diaphragm 52 are formed in a dish shape by squeezing and processing a metallic plate material. The first diaphragm 51 is provided in a surface section at one end of the pressure vessel 20 which is an outer surface of the bottom portion 211 in this case. A circumferential portion of the first diaphragm 51 is welded to the bottom portion 211. Consequently, the first diaphragm 51 is air-tightly secured to the pressure vessel 20. In this case, a central portion of the first diaphragm 51 substantially matches a central portion of the bottom portion 211.

The second diaphragm 52 is provided in a surface section at the other end of the pressure vessel 20 which is an outer surface of the lid plate 22 in this case. A circumferential portion of the second diaphragm 52 is welded to the lid plate 22. Consequently, the second diaphragm 52 is air-tightly secured to the pressure vessel 20. In this case, a central portion of the second diaphragm 52 is shifted from the central portion of the lid plate 22.

Moving pressures of the first diaphragm 51 and the second diaphragm 52 vary. In this case, the moving pressures of the first diaphragm 51 and the second diaphragm 52 are varied by varying a pressure receiving area, a modulus of elasticity or the like. In the present embodiment, to move the first diaphragm 51 by the pressure that is lower than the pressure of the second diaphragm 52, an outer diameter, that is, the pressure receiving area of the first diaphragm 51 is set to be larger than an outer diameter, that is, the pressure receiving area of the second diaphragm 52. Note that the present invention is not limited to this example. The moving pressure of the diaphragm 51 or 52 can be set to a required value by suitably changing a plate thickness or material, a squeeze shape, a laminate structure or the like of the diaphragm 51 or 52.

The first diaphragm 51 is configured to be moved by a first moving pressure and is to be reset by a reset pressure that is lower than the first moving pressure. That is, the first diaphragm 51 is deformed to move when the pressure around the pressure switch 10 is in excess of the first moving pressure, and the first diaphragm resets itself to an original shape when the pressure around the pressure switch 10 is less than or equal to the reset pressure. In this case, the reset pressure is set to a pressure that is lower than the first moving pressure and is more than or equal to an atmospheric pressure. Therefore, even after the pressure around the pressure switch 10 becomes larger than the first moving pressure and the first diaphragm 51 is moved, the first diaphragm 51 resets itself when the pressure around the pressure switch 10 lowers to at least the atmospheric pressure.

In contrast, the second diaphragm 52 is configured to be moved by a second moving pressure and is not to be reset under the atmospheric pressure. The second moving pressure is set to a value that is higher than the first moving pressure. That is, the second diaphragm 52 is deformed to move when the pressure around the pressure switch 10 is in excess of the second moving pressure. Then, after the second diaphragm 52 is moved once, the diaphragm is not reset even if the pressure around the pressure switch 10 lowers to the atmospheric pressure.

In the present embodiment, the first moving pressure is set to, for example, approximately 4.0 MPa that is more than or equal to a condensation pressure at 65° C. of a refrigerant which is an abnormal pressure, and the reset pressure of the first diaphragm 51 is set to approximately 3 MPa that is the pressure during a normal operation. Furthermore, the second moving pressure is set to approximately 10 MPa that is more than or equal to the abnormal pressure at which there is a possibility that a compressor is damaged. Note that the first moving pressure, the reset pressure and the second moving pressure are not limited to the above values, and can be suitably changed in accordance with a use purpose, an installation environment or the like of the pressure switch 10.

The first plunger 61 is provided through the surface section at the one end of the pressure vessel 20 which is the bottom portion 211 in this case, and the first plunger 61 is configured to be movable in an axial direction of the first plunger 61. A base end 611 of the first plunger 61 is not in contact with the central portion of the first diaphragm 51, or is in contact to such an extent that the movable portion 441 is not moved. A tip end 612 of the first plunger 61 faces a first pressing point P1 side of the movable portion 441. In a state where the first diaphragm 51 is not moved, the tip end 612 of the first plunger 61 is not in contact with the first pressing point P1 of the movable portion 441, or is in contact to such an extent that the movable portion 441 is not moved.

Furthermore, the second plunger 62 is provided through the surface section at the other end of the pressure vessel 20 which is the lid plate 22 in this case, and the second plunger is configured to be movable in an axial direction of the second plunger 62. In this case, the axial direction, that is, a moving direction of the first plunger 61 matches the axial direction, that is, a moving direction of the second plunger 62. A base end 621 of the second plunger 62 is not in contact with the central portion of the second diaphragm 52, or is in contact to such an extent that the movable portion 441 is not moved. A tip end 622 of the second plunger 62 faces a second pressing point P2 side of the movable portion 441. In a state where the second diaphragm 52 is not moved, the tip end 622 of the second plunger 62 is not in contact with the second pressing point P2 of the movable portion 441, or is in contact to such an extent that the movable portion 441 is not moved.

In this configuration, when the pressure around the pressure switch 10 is a pressure in a range from the first moving pressure to the second moving pressure, the first diaphragm 51 moves. Consequently, the first plunger 61 is pushed by the first diaphragm 51 to press the first pressing point P1. Then, the movable portion 441 is moved toward the lid plate 22 while swinging about a vicinity of a contact portion with the elastic portion 442 as a fulcrum. Consequently, the movable contact 42 is moved away from the fixed contact 41. As a result, the contact mechanism 40 assumes the open state. Note that the contact portion between the movable portion 441 and the elastic portion 442 does not necessarily have to match the fulcrum portion of the swinging of the movable portion 441.

In this case, when the pressure around the pressure switch 10 is not in excess of the second moving pressure and lowers to the reset pressure or lower, the first diaphragm 51 resets itself to an initial state. Consequently, the first plunger 61 lowers downward to resets itself to an initial position by the elastic force or a dead weight of the elastic portion 442 which is transmitted via the movable portion 441. As a result, the pressed first pressing point P1 is released. Then, the movable portion 441 is reset to the initial state by an urging force of the elastic portion 442, and the movable contact 42 is moved in contact with the fixed contact 41 again. Consequently, the contact mechanism 40 is in the closed state again, even after the first diaphragm 51 is moved.

In contrast, when the pressure around the pressure switch 10 is in excess of the second moving pressure, the second diaphragm 52 also moves in addition to the first diaphragm 51. Then, the second plunger 62 is pushed by the second diaphragm 52 to press the second pressing point P2. Consequently, the movable portion 441 is pressed also by the second plunger 62 in addition to the first plunger 61. Then, the movable portion 441 is moved toward the lid plate 22 while swinging about the vicinity of the contact portion with the elastic portion 442 as the fulcrum. Consequently, the movable contact 42 is moved away from the fixed contact 41.

In this case, the second diaphragm 52 is moved once. Therefore, even when the pressure around the pressure switch 10 lowers to the reset pressure or less and the first diaphragm 51 resets itself, the second diaphragm 52 is not reset. Therefore, the pressed second pressing point P2 is not released and is maintained. Therefore, the movable contact 42 does not come in contact with the fixed contact 41 again. As a result, the open state of the contact mechanism 40 is maintained.

Figure 4:
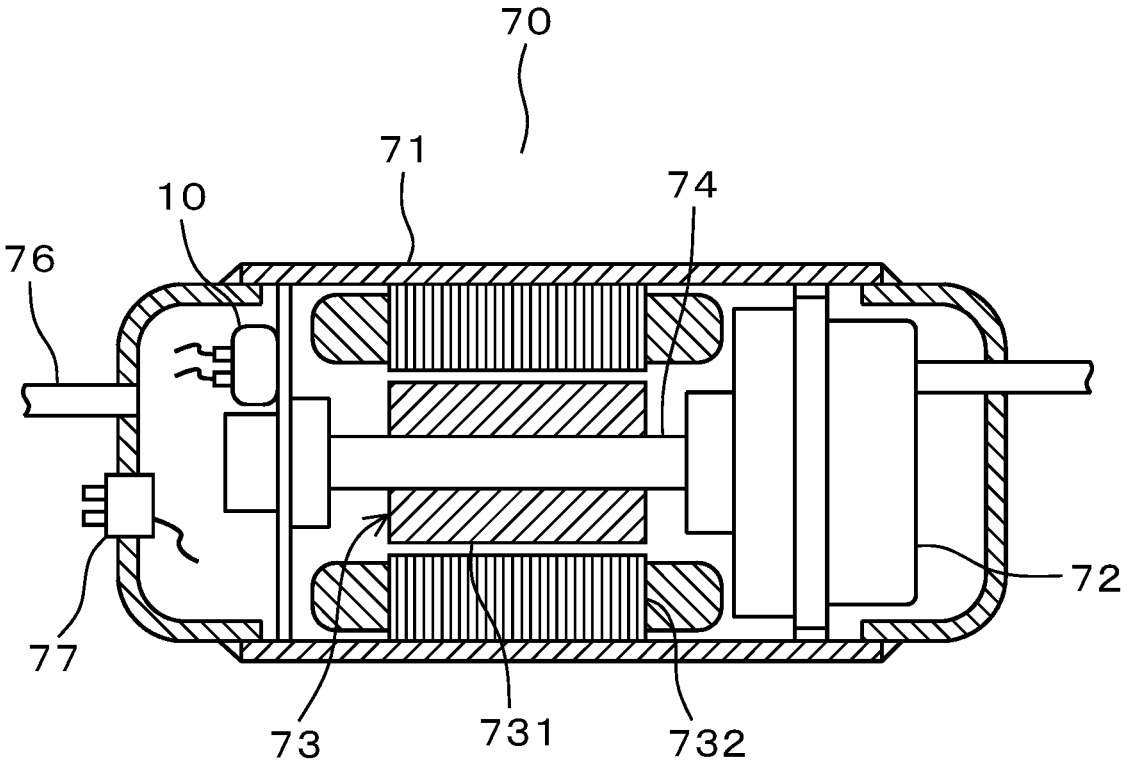
FIG. 4 is a cross-sectional view showing one example of a hermetically sealed electric compressor according to the first embodiment.
Figure 5:
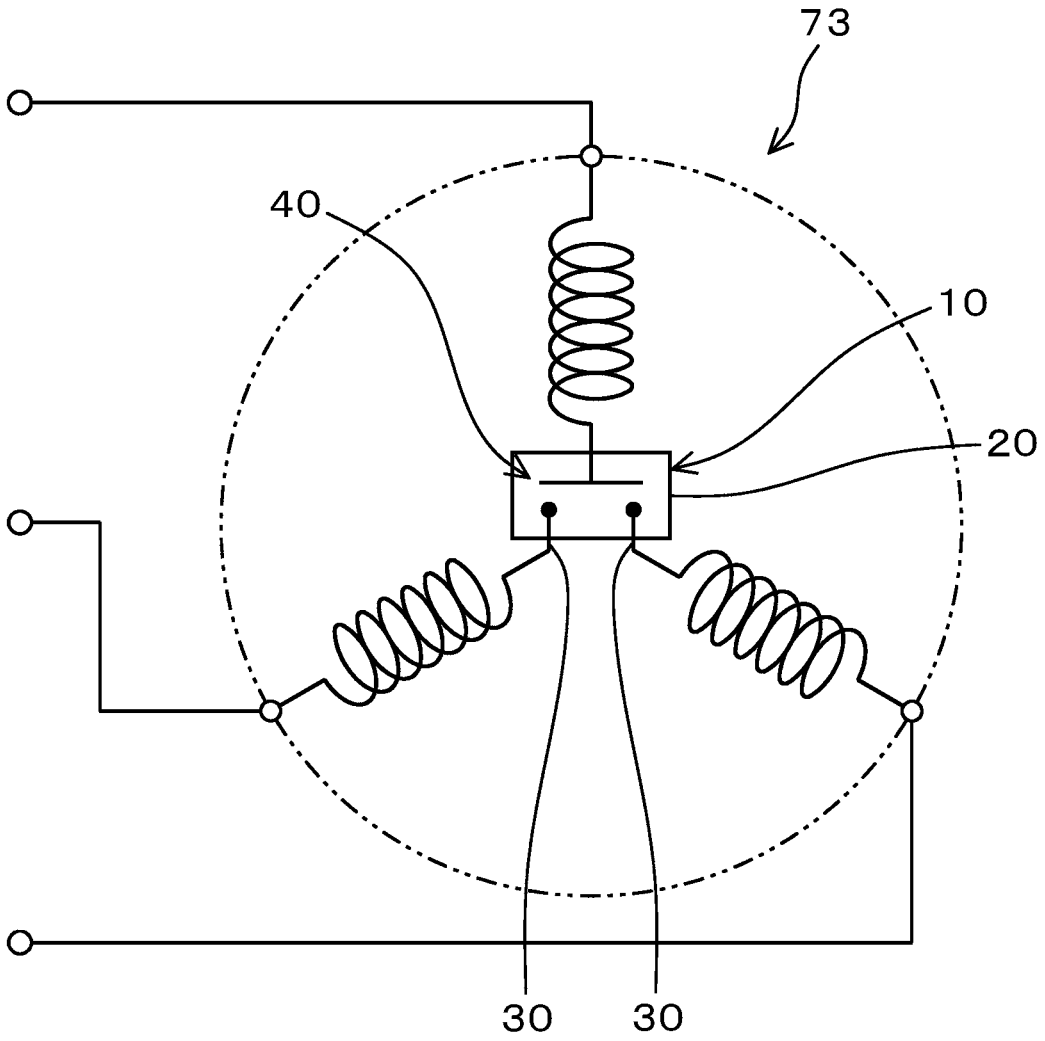
FIG. 5 is a conceptual diagram of the hermetically sealed electric compressor according to the first embodiment which shows a connection form of the pressure switch to a three-phase motor.

The pressure switch 10 of the above configuration can be applied as a pressure protection device of, for example, a hermetically sealed electric compressor 70 (hereinafter referred to simply as the compressor 70) as shown in FIG. 4 and FIG. 5. The compressor 70 is a totally hermetically sealed or semi hermetically sealed electric compressor for the refrigerant, and is for use in, for example, an air conditioner, to constitute a part of a refrigeration cycle. The compressor 70 includes a compressor vessel 71, a compression mechanism 72, and a motor 73. The compressor vessel 71 is a vessel having the airtightness and pressure resistance, and constitutes a shell of the compressor 70.

Each of the compression mechanism 72 and the motor 73 is provided inside the compressor vessel 71. The motor 73 has a rotor 731 and a stator 732. The compression mechanism 72 and the motor 73 are coupled to each other by a shaft 74. Consequently, a rotary force of the motor 73 is transmitted to the compression mechanism 72, and the compression mechanism 72 is driven. Furthermore, the compressor vessel 71 is air-tightly connected to a suction tube 75 and a discharge tube 76. The suction tube 75 is for guiding the refrigerant from an unshown heat exchanger or the like to the compression mechanism 72 in the compressor vessel 71. The discharge tube 76 is for discharging the refrigerant compressed by the compression mechanism 72 to send the refrigerant to the unshown heat exchanger.

Furthermore, the compressor 70 includes an airtight terminal unit 77. The airtight terminal unit 77 is provided air-tightly through the compressor vessel 71, to connect the motor 73 in the compressor vessel 71 to an external power source. That is, power supply to the motor 73 is performed via the airtight terminal unit 77.

The pressure switch 10 is provided inside the compressor vessel 71, and connected to a power line of the motor 73. In the present embodiment, the motor 73 is a three-phase motor of so-called Y-connection. Then, the pressure switch 10 is connected to a neutral point of the Y-connection of the three-phase motor 73 as shown in FIG. 5. In this case, the power lines of two phases among the power lines of the three phases of the motor 73 are secured to two airtight terminals 30, respectively, by the welding or the like, and are electrically connected thereto. Then, the power line of the remaining phase among the power lines of the three phases of the motor 73 is secured to a circumferential surface of the pressure vessel 20 by the welding or the like, and is electrically connected thereto.

In this configuration, when the pressure in the compressor vessel 71 is in excess of the first moving pressure, the first diaphragm 51 moves as described above, and the contact mechanism 40 assumes the open state. As a result, the power supply to the motor 73 is cut off to stop the compressor 70. In this case, if the pressure in the compressor vessel 71 is not in excess of the second moving pressure, the second diaphragm 52 does not move. Consequently, when the pressure in the compressor vessel 71 lowers to the reset pressure or lower, for example, when the compressor vessel is opened to the atmospheric pressure, the first diaphragm 51 resets itself. As a result, the contact mechanism 40 is in the closed state again, so that the power supply to the motor 73 can restart.

In contrast, when the pressure in the compressor vessel 71 is in excess of the second moving pressure, the second diaphragm 52 also moves. In this case, when the pressure in the compressor vessel 71 lowers to the reset pressure or lower, for example, when the compressor vessel is opened to the atmospheric pressure and the first diaphragm 51 resets itself, the second diaphragm 52 is not reset. As a result, the open state of the contact mechanism 40 is maintained, and a power cut-off state to the motor 73 continues.

According to the above described embodiment, the pressure switch 10 includes the airtight metallic pressure vessel 20, the at least one airtight terminal 30, the contact mechanism 40, the first diaphragm 51, the second diaphragm 52, the first plunger 61, and the second plunger 62. The contact mechanism 40 is provided inside the pressure vessel 20, and is normally in the closed state and assumes the open state when the pressing force acts thereon. The airtight terminal 30 is provided through the end surface section of the pressure vessel 20, and connected to the contact mechanism 40.

The first diaphragm 51 is metallic, and is air-tightly secured to the surface section at the one end of the pressure vessel 20 which is the bottom portion 211 in this case. The first diaphragm 51 is moved by the first moving pressure, and is to be reset by the reset pressure that is lower than the first moving pressure, that is, configured to reset itself. The first plunger 61 is provided through the surface section at the one end of the pressure vessel 20 which is the bottom portion 211 in this case, and the first plunger can be caused by the movement of the first diaphragm 51 to press the contact mechanism 40 and then switch to the open state.

Furthermore, the second diaphragm 52 is metallic and is air-tightly secured to the surface section at the other end of the pressure vessel 20 which is the lid plate 22 in this case. The second diaphragm 52 is configured to be moved by the second moving pressure that is higher than the first moving pressure, and is not to be reset under at least the atmospheric pressure. The second plunger 62 is provided through the surface section at the other end of the pressure vessel 20 which is the lid plate 22 in this case, and can be caused by the movement of the second diaphragm 52 to press the contact mechanism 40 and then switch to the open state.

That is, according to the above configuration, one pressure switch 10 can achieve two different types of movement modes, that is, a movement mode in which the pressure switch is to be reset by the first diaphragm 51 and a movement mode in which the pressure switch is not to be reset by the second diaphragm 52. Consequently, one pressure switch 10 can cope with both pressure abnormalities including a pressure abnormality caused by temporary overload and a pressure abnormality caused by an excess of the temporary overload, without providing two pressure switches. Therefore, the number of the necessary pressure switches can be decreased, and as a result, a mounting space of the pressure switch 10 can be decreased to contribute to miniaturization of the compressor 70 or the like. Furthermore, the number of components can be decreased to decrease the number of manufacturing steps of the compressor 70 and cost thereof.

The contact mechanism 40 has at least one fixed member 43, and the movable mechanism section 44. In the fixed member 43, at least one fixed contact 41 is provided. In the movable mechanism section 44, the movable contact 42 is provided. The movable mechanism section 44 can bring the movable contact 42 away from and into contact with the fixed contact 41. The movable mechanism section 44 has the movable portion 441 and the elastic portion 442. The movable portion 441 has the first pressing point P1 to be pressed by the first plunger 61, and the second pressing point P2 to be pressed by the second plunger 62.

One end of the elastic portion 442 is fixed to the lid plate 22 of the pressure vessel 20. The elastic portion 442 urges the movable portion 441 so that the fixed contact 41 and the movable contact 42 assume the closed state, and supports the movable portion 441 so that the movable contact 42 is movable in the direction away from the fixed contact 41. In this configuration, the contact mechanism 40 moves the movable contact 42 away from the fixed contact 41 when the first pressing point P1 is pressed by the first plunger 61, and moves the movable contact 42 away from the fixed contact 41 when the second pressing point P2 is pressed by the second plunger 62.

Consequently, the contact mechanism 40 is configured to be movable by pressing either one or both of two pressing points P1 and P2 set to one movable portion 441. Consequently, it is not necessary to provide two movable portions to cope with two types of moving pressures. Therefore, the number of the components of the contact mechanism 40 can be decreased, and the miniaturization of the pressure switch 10 can be achieved. As a result, the mounting space of the pressure switch 10 can be further decreased to further contribute to the miniaturization of the compressor 70 or the like.

The movable portion 441 is formed in a plate shape. Furthermore, the elastic portion 442 is constituted of the U-shaped leaf spring. One end of the U-shape of the elastic portion 442 is secured to the lid plate 22 of the pressure vessel 20 in this case, and the other end thereof is secured to the central portion of the movable portion 441, to swingably support the movable portion 441. According to this configuration, the movable mechanism section 44 can be constituted of the plate-like movable portion 441 and the U-shaped leaf spring 442, and hence the movable mechanism section 44 can be comparatively simply configured. As a result, the miniaturization of the pressure switch 10 can be achieved, and decrease of the number of assembling steps can be also achieved.

Furthermore, the airtight terminal 30 is provided in the surface section at the other end of the pressure vessel 20 which is the lid plate 22 in this case. That is, the airtight terminal 30 is provided together with the second diaphragm 52 in the lid plate 22. In this case, the pressure receiving area, that is, the outer diameter of the second diaphragm 52 is smaller than that of the first diaphragm 51. Consequently, also when the first diaphragm 51 is provided over the whole bottom portion 211 so that any installing space of the airtight terminal 30 cannot be acquired on the bottom portion 211 side, the space for the airtight terminal 30 can be easily acquired on the lid plate 22 side. Therefore, to acquire the installing space of the airtight terminal 30, the area of the bottom portion 211 does not have to be increased, and as a result, the pressure switch 10 can be further reduced in size.

The hermetically sealed electric compressor 70 includes the pressure switch 10 provided inside the compressor vessel 71 and connected to the power line of the motor 73. In this case, the motor 73 is the three-phase motor. Furthermore, the pressure switch 10 is connected to the neutral point of the motor 73. In this case, for example, the first moving pressure of the pressure switch 10 is set to a pressure value at which it is preferable that the pressure switch can be reset as in the pressure abnormality caused by the temporary overload of the refrigeration cycle. Furthermore, the second moving pressure is set to a pressure value at which it is preferable that the pressure switch cannot be reset as in the pressure abnormality cause in the range in excess of the temporary overload of the refrigeration cycle.

According to this configuration, the pressure switch 10 cuts off the power supply to the motor 73 in a state where the pressure switch is to be reset, when the pressure abnormality is caused to such an extent that it is preferable that the switch can be reset. The pressure switch cuts off the power supply to the motor 73 in a state where the switch is not to be reset, when the pressure abnormality is caused to such an extent that it is preferable that the switch cannot be reset. Consequently, when the pressure abnormality is caused by the temporary overload or the like, the pressure switch 10 is reset so that the motor 73 can restart. Therefore, time and labor to repair and replace the pressure switch 10 can be saved. Furthermore, when the pressure abnormality is caused by an excess of the temporary overload, the pressure switch 10 cannot be reset so that the motor 73 cannot restart. Therefore, re-energization to the motor 73 can be prevented, and a secondary accident which might occur in case of the re-energization can be prevented.

Second Embodiment

Figure 6:
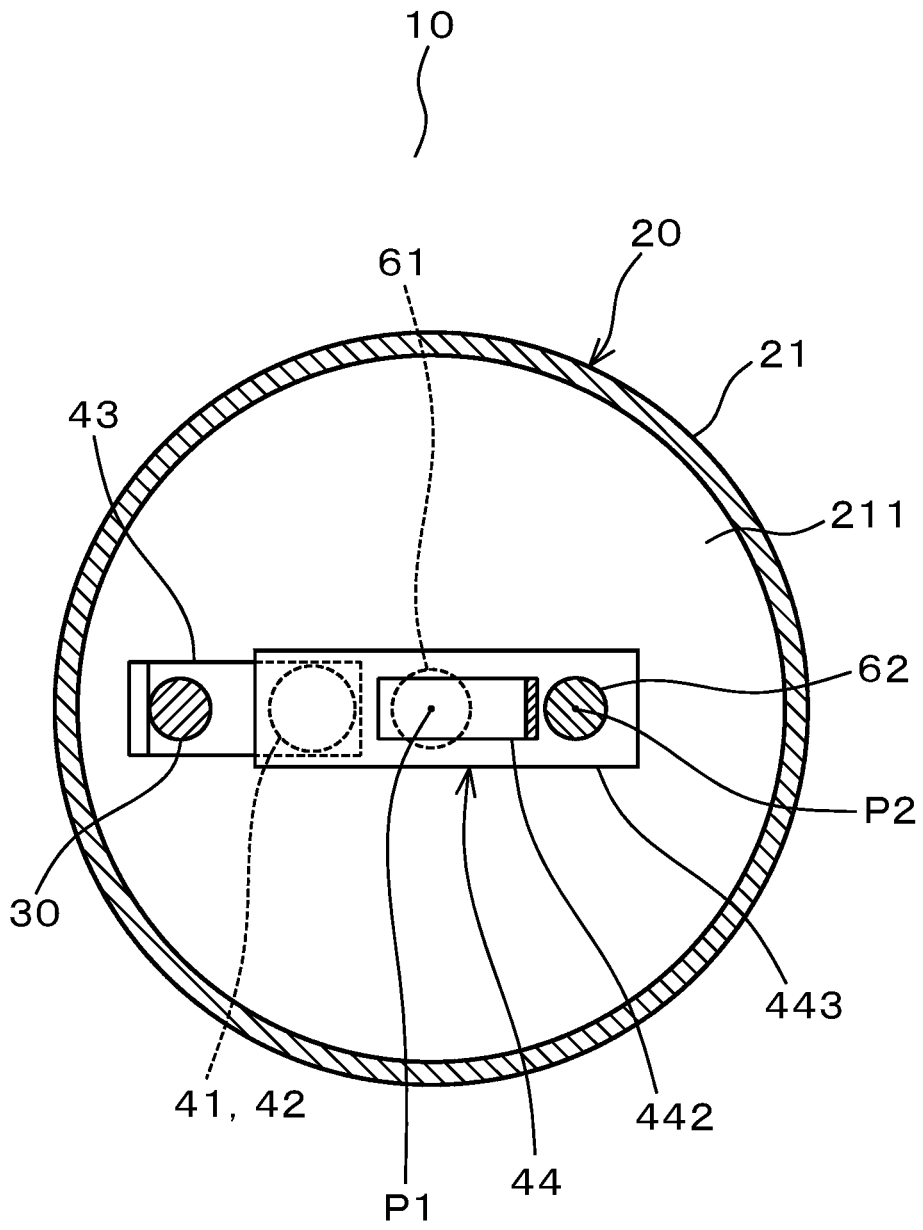
FIG. 6 is cross-sectional view showing a pressure switch according to a second embodiment and corresponding to FIG. 3.

Next, a second embodiment will be described with reference to FIG. 6.

In the second embodiment, a contact mechanism 40 has one airtight terminal 30, one fixed contact 41 and one movable contact 42. In this case, a movable mechanism section 44 has a movable portion 443 in place of the movable portion 441 of the above embodiment. The movable portion 443 is metallic, and is formed in a simply rectangular plate shape in the same manner as in the movable portion 441.

According to this configuration, technological effects similar to those of the above first embodiment can be obtained.

Furthermore, a pressure switch 10 of the second embodiment is suitable for, for example, a single-phase motor.

Third Embodiment

Figure 7:
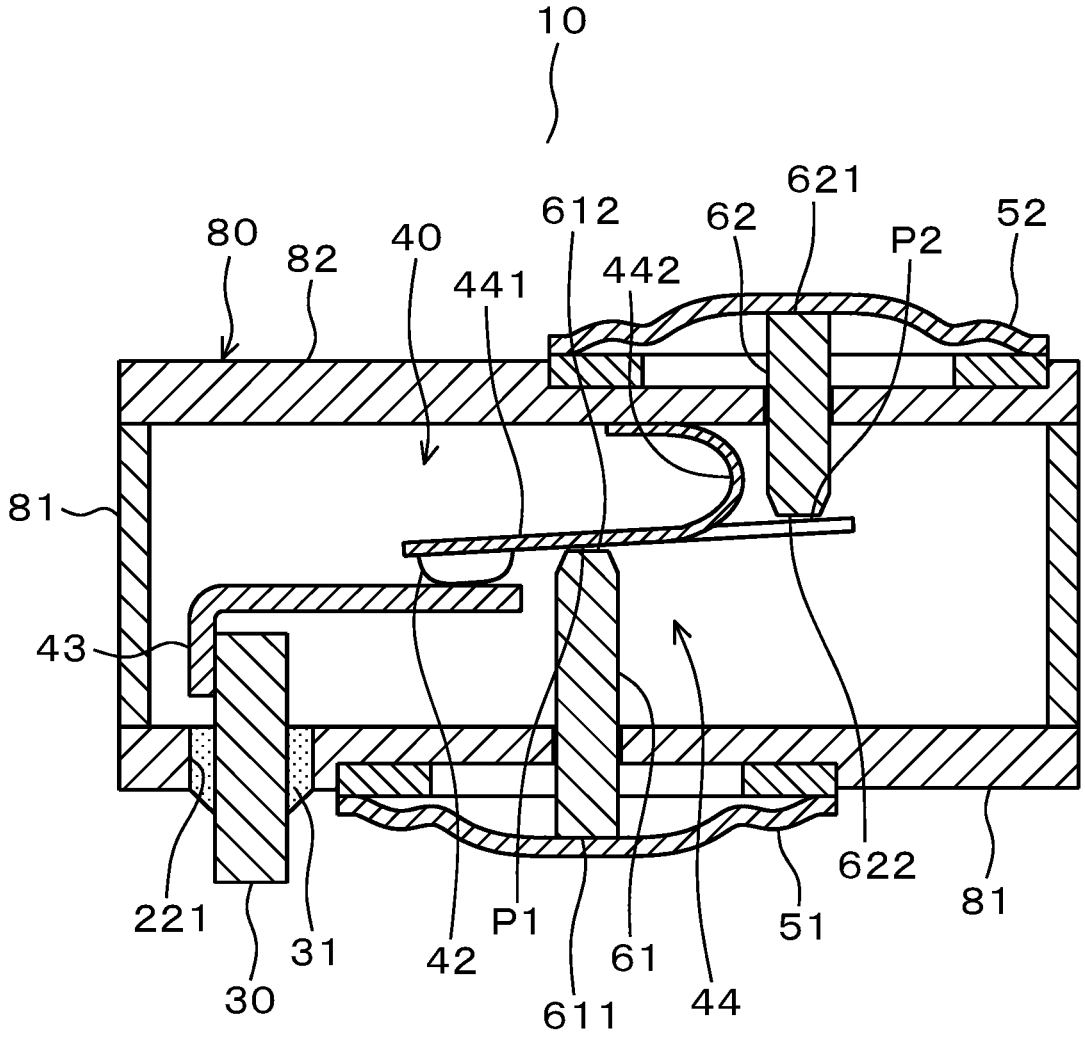
FIG. 7 is cross-sectional view showing a pressure switch according to a third embodiment and corresponding to FIG. 2.

Next, a third embodiment will be described with reference to FIG. 7.

The third embodiment is different from the first embodiment in a structure of a pressure vessel 20, a position of an airtight terminal 30, and a size of a first diaphragm 51. That is, in the third embodiment, a pressure switch 10 includes a pressure vessel 80 in place of the pressure vessel 20. The pressure vessel 80 is a metallic hermetically sealed vessel having an airtightness and conductivity, and includes a vessel body 81 and two lid plates 821 and 822. The vessel body 81 is formed in a cylindrical shape that is open on both sides. The two lid plates 821 and 822 are secured to the open sides of the vessel body 81, respectively, by welding or the like, and the vessel body 81 is hermetically sealed.

In the following description, the lid plate 821 including a first diaphragm 51 will be referred to as the first lid plate 821, and the lid plate 822 including a second diaphragm 52 will be referred to as the second lid plate 822. In the present embodiment, the airtight terminal 30 is provided through the lid plate 821 including the first diaphragm 51. In this case, an outer diameter, that is, a pressure receiving area of the first diaphragm 51 is equal to an outer diameter, that is, a pressure receiving area of the second diaphragm 52. Therefore, moving pressures of the first diaphragm 51 and the second diaphragm 52 are varied, for example, by adjusting a material and a thickness of the first diaphragm 51 and the second diaphragm 52.

Furthermore, the pressure switch 10 of the third embodiment does not include a fixed contact 41, and a fixed member 43 also serves as a fixed contact. That is, in the fixed member 43 of the present embodiment, the fixed contact is a contact portion with a movable contact 42 of the fixed member 43. Note that the pressure switch 10 may include the fixed contact 41 and may not include the movable contact 42, and a movable portion 441 may also serve as a movable contact. In this case, the movable contact becomes a contact portion with the fixed contact 41 of the movable portion 441.

Also according to this embodiment, technological effects similar to those of each of the above embodiments can be obtained.

Note that the present invention is not limited to the above described respective embodiments, and can be variously extended and modified without departing from the gist of the invention.

For example, the pressure switch 10 may be configured to include one fixed contact 41 and one movable contact 42 and one fixed member 43 for a plurality of airtight terminals 30. In this case, each of the plurality of airtight terminals 30 may be connected to the one fixed member 43.

Furthermore, coil springs or the like that assist the respective diaphragms 51 and 52 may be provided around the first plunger 61 between the first diaphragm 51 and the bottom portion 211, and around the second plunger 62 between the second diaphragm 52 and the lid plate 22.

Additionally, the pressure vessels 20 and 80 are not limited to the substantially cylindrical shape with the cross section being round, and for example, the cross section may have a rectangular shape or the like. However, when the pressure vessel 20 or 80 is formed in the substantially cylindrical shape with the cross section being round, affinity with the diaphragm 51 or 52 improves. The pressure vessel can be further miniaturized as compared with the case where the cross section is formed in the rectangular shape.

In addition, the pressure switch 10 can be applied to any device other than the compressor 70.

The invention claimed is:

1. A pressure switch comprising:

an airtight metallic pressure vessel, a contact mechanism, which is provided inside the pressure vessel, and which assumes an open state from a closed state when a pressing force acts thereon, at least one airtight terminal provided through an end surface section of the pressure vessel and connected to the contact mechanism, a metallic first diaphragm, which is air-tightly secured to a surface section at one end of the pressure vessel, and which is deformed to move by a first moving pressure that is higher than an atmospheric pressure and is to be reset to its original shape by a reset pressure that is lower than the first moving pressure, a first plunger provided through the surface section at the one end of the pressure vessel, and caused by the movement of the first diaphragm to press the contact mechanism and then switch to the open state, a metallic second diaphragm, which is air-tightly secured to a surface section at the other end of the pressure vessel, and which is deformed to move by a second moving pressure that is higher than the reset pressure and the first moving pressure and is not to be reset under an atmospheric pressure, and a second plunger provided through the surface section at the other end of the pressure vessel, and caused by the movement of the second diaphragm to press the contact mechanism and then switch to the open state.

2. The pressure switch according to claim 1, wherein the contact mechanism has:

at least one fixed member including a fixed contact, and a movable mechanism section including a movable contact and configured to enable the movable contact to move away from and come into contact with the fixed contact, the movable mechanism section has:

a movable portion having a first pressing point to be pressed by the first plunger and a second pressing point to be pressed by the second plunger, and an elastic portion having one end fixed to the pressure vessel, and configured to urge the movable portion so that the fixed contact and the movable contact assume the closed state and to support the movable portion so that the movable contact is movable in a direction away from the fixed contact, and the movable contact is moved away from the fixed contact when the first pressing point is pressed by the first plunger, and the movable contact is moved away from the fixed contact when the second pressing point is pressed by the second plunger.

3. The pressure switch according to claim 2, wherein the movable portion is formed in a plate shape, and the elastic portion comprises a leaf spring formed in a U-shape, one end of the U-shape being secured to the pressure vessel and the other end thereof being secured to a central portion of the movable portion, to swingably support the movable portion.

4. The pressure switch according to claim 1, wherein the airtight terminal is provided in the surface section at the other end of the pressure vessel.

5. A hermetically sealed electric compressor comprising:

an airtight compressor vessel, a compression mechanism provided inside the compressor vessel to compress and discharge a refrigerant, a motor provided inside the compressor vessel to drive the compression mechanism, and the pressure switch according to any one of claims 1 to 4 provided inside the compressor vessel and connected to a power line of the motor.

6. The hermetically sealed electric compressor according to claim 5, wherein the contact mechanism has:

two fixed members having two fixed contacts connected to two airtight terminals, respectively, and one movable mechanism section having two movable contacts which are enabled to move away from and come into contact with the two fixed contacts, the motor is a three-phase motor, and the pressure switch is connected to a neutral point of the motor.

* * * * *